US005213235A

United States Patent [19]

Miranda

[11] Patent Number: 5,213,235

[45] Date of Patent: May 25, 1993

[54] MONOBLOCK PLASTIC TUBE

[75] Inventor: Renato Miranda, São Paulo, Brazil

[73] Assignee: Bunzl Plastics, Inc., Florham Park, N.J.

[21] Appl. No.: 748,543

[22] Filed: Aug. 22, 1991

[51] Int. Cl.[5] ..... B65D 35/08

[52] U.S. Cl. ..... 222/107; 222/498; 222/517; 222/556; 215/236; 215/321

[58] Field of Search ..... 222/105, 107, 212, 215, 222/498, 541, 545, 546, 556, 517; 215/235, 321, 331, 236

[56] References Cited

U.S. PATENT DOCUMENTS

| | | | |
|---|---|---|---|
| 3,255,937 | 6/1966 | Jarrett | 222/498 X |
| 4,022,352 | 5/1977 | Pehr . | |
| 4,358,032 | 11/1982 | Libit . | |
| 4,598,839 | 7/1986 | Dombroski et al. . | |
| 4,653,676 | 3/1987 | Stull | 222/212 X |
| 4,793,502 | 12/1988 | Beck . | |
| 4,815,616 | 3/1989 | Selvinis . | |
| 4,901,892 | 2/1990 | Song | 222/541 X |
| 4,911,337 | 3/1990 | Rosenthal | 222/498 |
| 5,105,989 | 4/1992 | Gutkowski | 222/212 X |

*Primary Examiner*—Gregory L. Huson
*Attorney, Agent, or Firm*—Oliff & Berridge

[57] ABSTRACT

A monoblock tube includes a monoblock body having a cylindrical configuration and a cap comprising a first portion and second portion hingedly connected by at least one hinge member. The body includes an upper part and a lower part, the upper part of the body including a circular area of a smaller diameter than the body and concentric therewith. The circular area includes a substantially T-shaped recessed portion which includes a cap fixture portion located toward a base of the "T" shape and a non-centralized substantially circular spout located opposite the fixture portion, the spout being in fluid communication with an interior side of the tube. The cap is substantially T-shaped to fit within the recessed portion of the circular area and the first portion is adapted to be releasably attached to the cap fixture portion. The second portion is hingedly movable by the hinge between an open position and a closed position. The spout is initially molded without an opening to deter or readily make known any tampering to the contents of the tube. The spout may be opened for use by cutting across the spout.

16 Claims, 5 Drawing Sheets

MONOBLOCK PLASTIC TUBE

BACKGROUND OF THE INVENTION

1. Field of the Invention

The present invention relates to a tube or bottle to pack fluid or pasty products, such as mayonnaise or the like. The tube is fabricated preferably in plastic with a monoblock body having an upper T-shaped recessed portion for accommodating a spring mechanism in a cap removably fastened to the body for reception within the recessed portion.

2. Description of Related Art

U.S. Pat. No. 4,022,352 discloses a container cover and safety closure having a cap member integrally with or mounted on the container. The closure has a centralized hole and a closure member hingedly movable between an open position spaced away from the aperture and a closed position which covers the aperture. The closure has a central portion which is recessed from the rest of the closure and the closure member is shaped to fit within the recessed area.

U.S. Pat. No. 4,358,032 discloses a snap container closure. The closure comprises a base portion having an aperture and a top portion, the closure being fixed to a bottle. The top portion includes a hinge divided into two portions. A first portion is held in an overlying relationship spaced from the aperture while a second portion is movable between an open and a closed position by bending about a hinge. The first portion includes nipples which pressingly fit in recesses of the base portion to retain the first portion in position.

U.S. Pat. No. 4,793,502 discloses a container having a hinged dispensing cap for closing an off-center aperture. The hinge provides a snap action for opening and closing the cap.

U.S. Pat. No. 4,815,616 discloses an angled dispensing closure having a snap cover which covers an orifice and is biased about hinges by a biasing element.

U.S. Patent RE 30,861 discloses biased hinges for closure caps.

U.S. Pat. No. 4,598,839 discloses a tamper evident squeeze tube which comprises an elongated tube having flexible walls which are sealed at one end. An end cap is provided at the other end and includes a frangible sealing member across an opening therein. The sealing member is a flexible dome member which is frangibly and integrally connected to the end cap. The dome member may be grasped and broken to access the contents of the tube.

The disclosures of all of the above-identified patents are herein incorporated by reference. While these known closures are adequate for most purposes, they fail to provide an easily manufactured monoblock or integral tube and closure assembly. They also fail to provide a closure assembly having different levels of relief to facilitate both fastening of the closure member to the container and opening of the closure member. The known closures also fail to provide a snap action hinge mechanism which is received in a low relief area to cover the hinge with the cap when the cap is closed on the container.

SUMMARY OF THE INVENTION

It is an object of the present invention to provide a tube container or the like which is easily fabricated from a formable material such as plastic including a cap retention mechanism.

It is another object of the present invention to provide a monoblock tube having an integral spout and a cap fixture portion, the cap fixture portion being designed to retain a portion of a hinged closure cap.

It is another object of the present invention to provide a tube container which includes a tamper evident structure.

It is another object of the present invention to provide a tube container which insures proper sealing of a spout when a cap is in a closed position by utilizing a ring member on the spout to frictionally engage with a cap member to retain the spout and cap in a sealed condition.

The present invention obviates the disadvantages of the prior art by providing an integrally molded monoblock tube comprising a monoblock body having a cylindrical configuration and a cap comprising a first portion and second portion hingedly connected by at least one hinge member. The body comprises an upper part and a lower part, the upper part of the body including a circular area of a smaller diameter than the body and concentric therewith. The circular area includes a substantially T-shaped recessed portion which includes a cap fixture portion located toward a base of the "T" shape and a non-centralized substantially circular spout located opposite the fixture portion, the spout being in fluid communication with an interior side of the tube. The cap is substantially T-shaped to fit within the recessed portion of the circular area and the first portion is adapted to be releasably attached to the cap fixture portion. The second portion is hingedly movable by the hinge between an open position and a closed position. The spout is initially molded without an opening to deter or readily make known any tampering to the contents of the tube. The spout may be readily opened for use by cutting across the spout to expose a cavity therein which directly communicates with the interior of the tube.

BRIEF DESCRIPTION OF THE DRAWINGS

These and other objects will become apparent from a reading of the following detailed description of the invention with reference to the following drawings wherein.

DETAILED DESCRIPTION OF PREFERRED EMBODIMENTS

Figure 1:
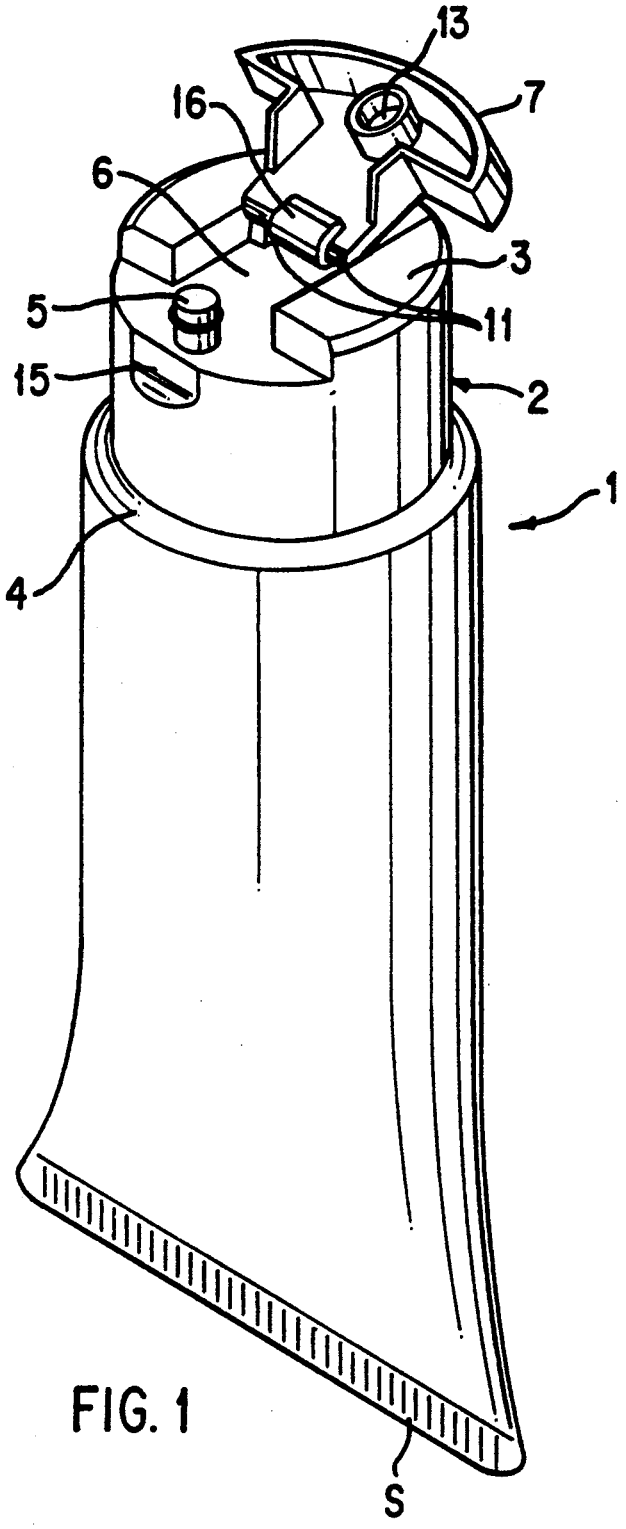
FIG. 1 is a perspective view of a tube including a cap according to the present invention.

Referring to the drawings, and in particular to FIG. 1, a tube container is shown having a cylindrical configuration. The container comprises a lower body part 1 and an upper part 2. The lower body part 1 is closed at the bottom edge by a seam S. It is noted, however, that the bottom edge is initially open and defines a cylindrical opening into the tube through which the contents of the tube are supplied. After filling the tube with the contents, the bottom end is closed by the seam S.

The upper part 2 of the tube includes a circular area 3 having a smaller diameter in relation to the lower body part 1 and concentric therewith. A shoulder 4 is located intermediate the two parts.

Figure 4A:
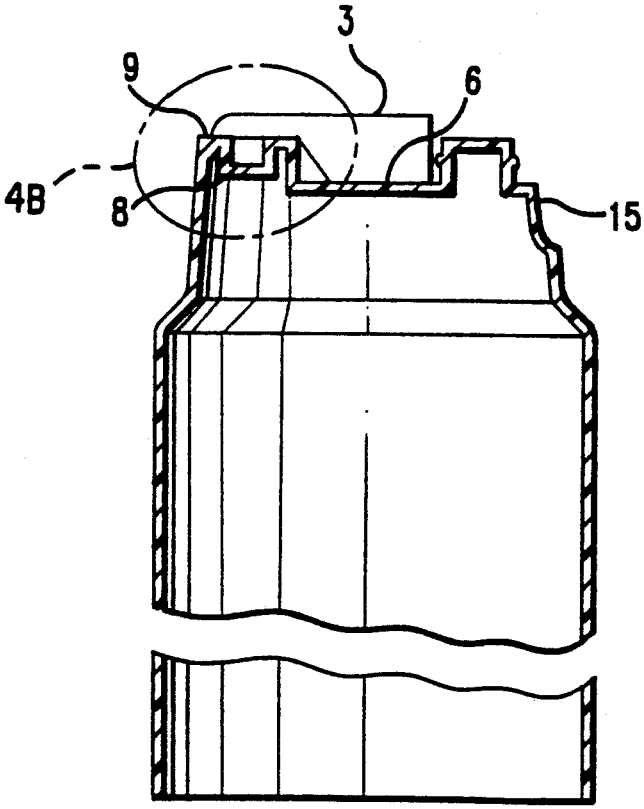
FIG. 4A is a cut view taken along line A—A of FIG. 3 without the cap and FIG. 4B is a detailed view of the circled area of FIG. 4.
Figure 4B:
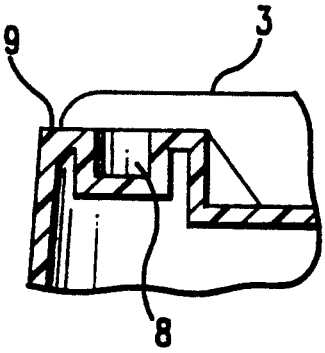
Figure 5C:
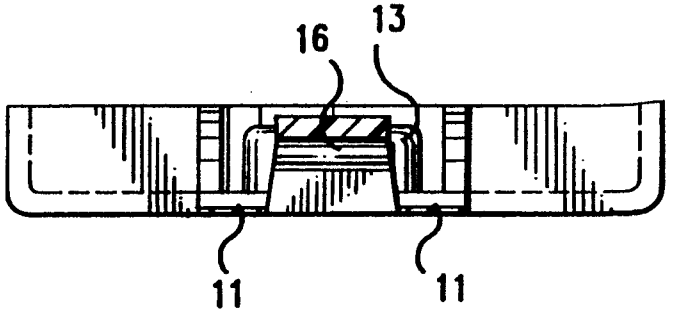
FIG. 5C is a cut view of the cap of FIG. 5A taken along line B—B.
Figure 5B:
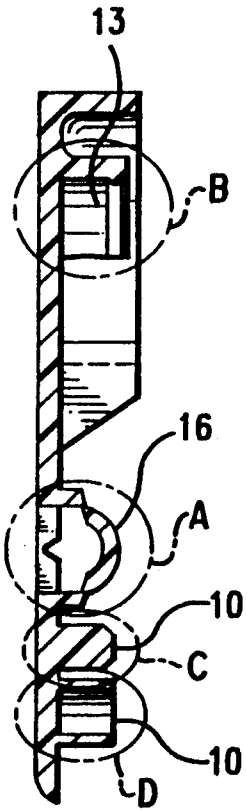
FIG. 5B is a cut view of the cap of FIG. 5A taken along line A—A.
Figure 5A:
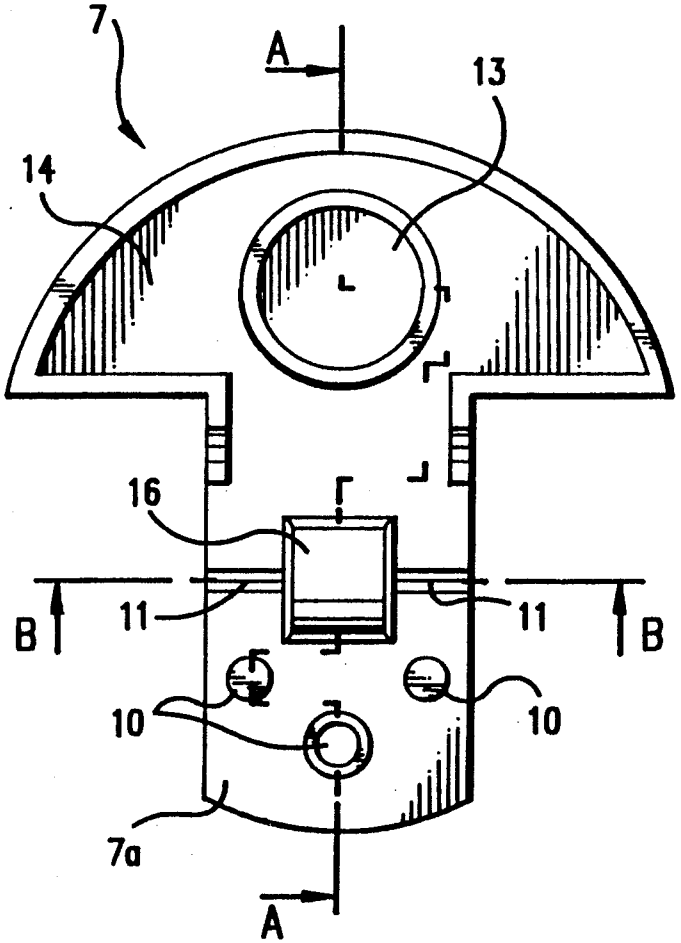
FIG. 5A is a plan view of the underside of the cap of FIG. 3.

The tube container is preferably molded from plastic and is formed by any of numerous methods of plastic molding known in the art. The circular area 3 includes a substantially T-shaped recessed area (see FIGS. 1 and 2B) which includes a low relief area 6 and a high relief area 9, which is preferably parallel to but raised by a step 9S from the low relief area 6. The step 9S has a notch 9N formed therein. The high relief area 9 is lower than the circular area 3, as illustrated in FIGS. 4A and 4B and is located at the base of the T-shaped recessed area. The high relief area 9 also includes a cap fixture portion for securing a cap 7 to the tube, as described below. When in a closed position, the cap 7 and the circular area 3 should form a substantially smooth level upper surface.

A circular spout 5 is located in the low relief area 6, and is non-centralized relative to the circular area 3. The spout 5 projects to the same level as the high relief area 9. The spout 5 also provides selective communication for the contents of the container to move from the lower part 1 to outside of the upper part 2.

The fixture of the cap 7 on the circular area 3 is made by non-perforated circular holes 8 (FIG. 2B, FIGS. 4A and 4B) which are placed on the cap fixture portion 9 to act as a fixture for the cap 7. As illustrated in FIGS. 1, 3, and 5A-5C, the cap 7 is comprised of a first portion 7*a* and a second portion 14 separated by two hinges 11 and a spring type articulation 16 (which is known from U.S. Patents RE 30,861 and 4,815,616, the disclosures of which are herein incorporated by reference). The cap is T-shaped to fit within the T-shaped recess of the tube. In the bottom face of the first portion 7*a* of the cap 7 (FIGS. 5A, 5B, 6C and 6D) are molded pins 10 which are configured and positioned to correspond and mate with the respective non-perforated holes 8 of the cap fixture portion 9, thus allowing a secure, selectively removable fixture for the cap 7.

Figure 6D:
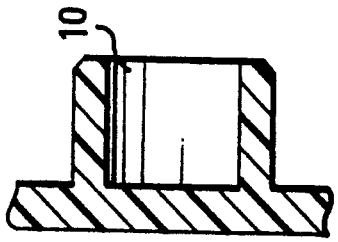
FIGS. 6A–D show details of circled areas C,D,E and F of FIG. 5B, respectively.
Figure 6C:
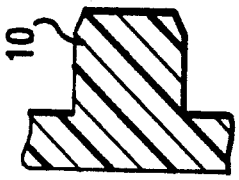
Figure 6B:
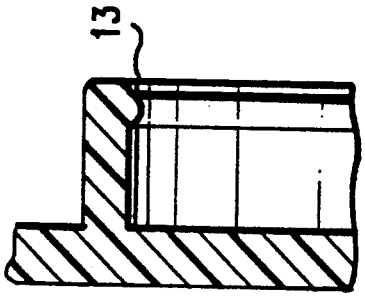
Figure 6A:
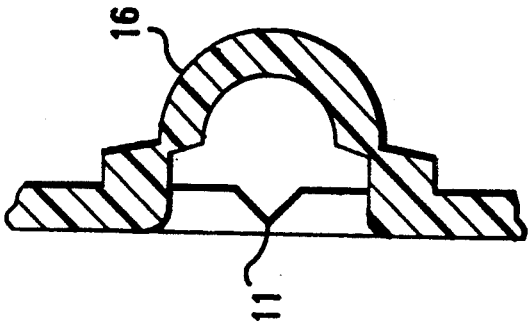

Once the cap 7 is fixed onto cap fixture portion 9 by mating of pins 10 with non-perforated holes 8, the second portion 14 of the cap 7 can be articulated by the hinges 11, between which spring type articulation 16 is positioned, between an open position and a closed position. A hinge 11 and articulation spring 16 are illustrated in detail in FIG. 6A. FIG. 1 illustrates the cap 7 in the open position wherein the spring articulation 16 urges the second portion 14 with snap action to overlie the first portion 7A. The spring articulation 16 also urges the second portion 14 with snap action to close the spout 5 (see FIG. 3). By snap action, it is intended that the spring 16 initially resists movement of the second portion 14 to a certain point, after which the resiliency of the spring 16 urges or "snaps" the second portion toward the open or closed position.

To better facilitate opening of the cap 7, a notch 15 is introduced with the shape of a wedge, on a forward edge of the low relief area 6 of circular area 3 as shown in FIG. 1. This allows a tip portion of T-shaped cap 7 to extend beyond the perimeter of the notch. A thumb or finger can easily dislodge the cap 7 from the closed position by applying a pressing force upward against the exposed tip.

The cap 7, and in particular second portion 14 of the cap 7, is provided with a cylindrical cavity 13 (see FIGS. 1, 5A-5C) which is sized to allow a tight fit around spout 5 upon movement of the second portion 14 of cap 7 to the closed position.

Figure 2A:
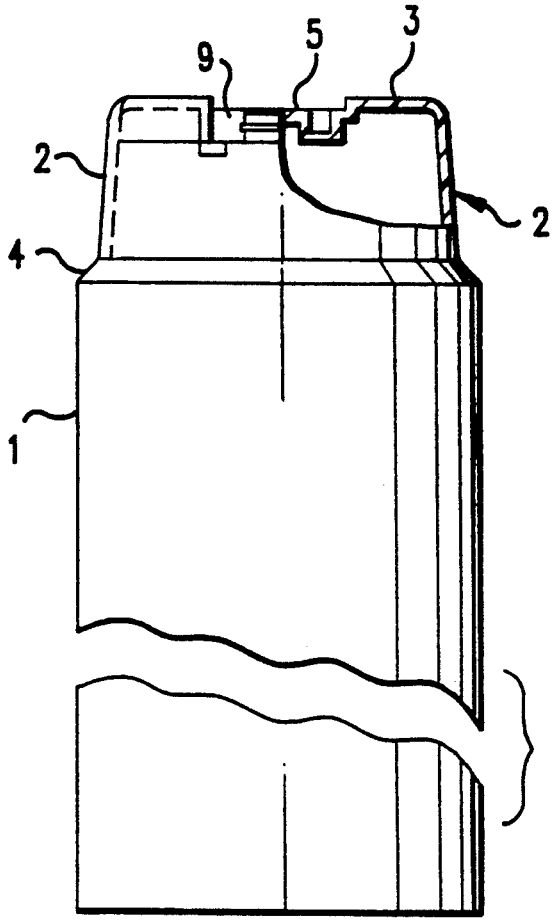
FIG. 2A is a partial cutaway view of the side of the tube of FIG. 1 without the cap.
Figure 2B:
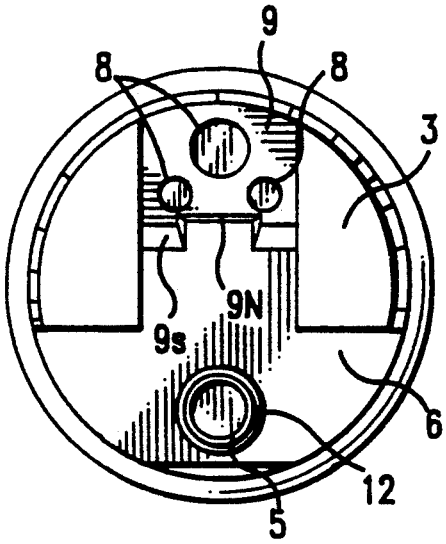
FIG. 2B is a top view of the tube of FIG. without the cap.
Figure 2C:
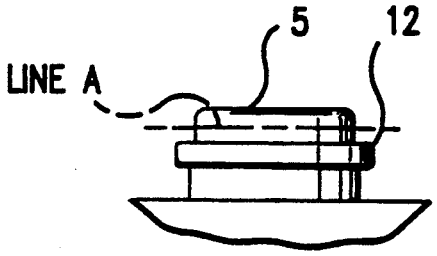
FIG. 2C is a partial side view of a spout portion of the tube of FIG. 1.
Figure 3:
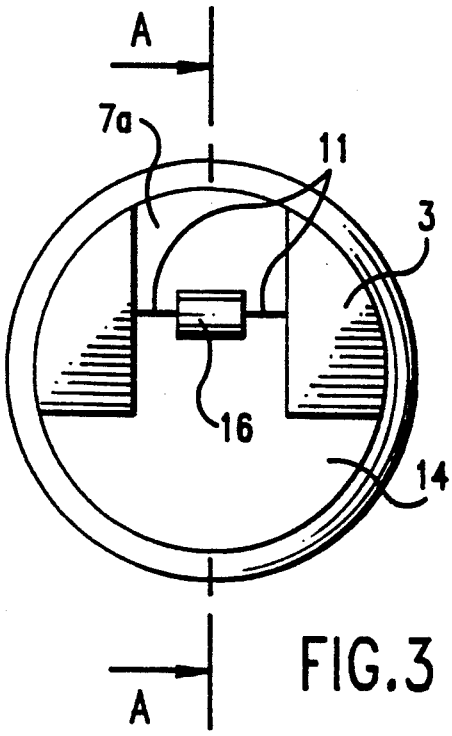
FIG. 3 is a top view of the tube of FIG. 1 with the cap.

The spout 5 preferably constitutes a tamper-evident spout. The spout 5 is preferably circular and has near a bottom thereof a ring 12 for sealing into cavity 13 of cap 7 upon closing of the cap. The ring 12 (FIG. 2C) is of a larger diameter than the diameter of the spout 5. Preferably, the diameter of the ring 12 is slightly larger than an interior diameter of cylindrical cavity 13 to provide a friction or interference fit. The spout 5 is integrally molded with the container tube and includes a cavity in direct fluid communication with the contents of body 1, but closed to external communication from the spout by a molded layer surrounding the spout. In order to release the contents of the body 1 through the closed cavity, the spout 5 must be cut along line A as shown in FIG. 2C. Upon cutting to expose the closed cavity of spout 5, the tamper evident aspect is destroyed making it possible to see the contents of the tube and to use the tube. The molded spout having a closed cavity simplifies filling of contents into the tube and eliminates any spillage or leakage of contents out of the tube prior to ultimate use. Preferably the cavity is star shaped to facilitate dispensing the contents of the body in a star pattern, as used in the pastry industry.

There are numerous advantages to producing the tube container as an integral monoblock member in one molding operation and fabricating a cap in a separate operation, the cap being fixedly held on the cap fixture portion 9 of the tube container. By molding a monotube body which includes the spout and the container as one unit, the mold operation of the tube allows for higher production rates. Secondly, the complexity of the mold is decreased since the cap which includes complex hinge members and other structures is formed in a separate operation. This also increases the production rate of the tube.

The structure of the T-shaped recessed portion with the low relief area 6 and high relief area 9 provides several additional advantages. It provides a T-shaped recess for a T-shaped cap 7 which facilitates opening. Further, the spring 16 is received in the low relief area 6 beneath the cap, and is thus protected, thereby also providing a smooth upper surface when the cap is closed. The spring 16 is received in the notch 9N as illustrated In FIG. 2B which allows for a compact structure without the recessed portion interfering with the operation of the spring 16.

The invention has been described with reference to the preferred embodiments thereof, which are illustrative and not limiting. Various changes may be made without departing from the spirit and scope of the invention as defined in the appended claims.

What is claimed is:

1. A monoblock tube comprising:

a monoblock body of a substantially cylindrical configuration having an upper part and a lower part, the upper part of the body including a circular area of a smaller diameter than the lower part and concentric therewith, the circular area including a substantially T-shaped recessed portion, the recessed portion including a cap fixture portion located toward a base of the "T" shaped recessed portion and a substantially circular spout non-centrally located in the circular area opposite the cap fixture portion, the spout having a predetermined diameter and being in communication with the lower part of the tube; and a removable cap comprising a first portion and second portion hingedly connected together by at least one hinge member, the cap being substantially T-shaped to fit within the recessed portion of the circular area, the first portion being releasably attached to the cap fixture portion and the second portion being hingedly movable by the at least one hinge member between an open position spaced away from the recessed portion and a closed position within the said recessed portion to close the spout.

2. The tube of claim 1, further comprising a cylindrical capping cavity located on a bottom face of the second portion of the cap formatably engaging with the spout, the cavity having an inner diameter sized to fit around the predetermined diameter of the spout to seal the spout.

3. The tube of claim 2, further comprising a sealing ring located around the spout and having an outer diameter larger than the predetermined diameter of the spout and no less than the inner diameter of the cavity to provide a friction fit between the sealing ring and the cavity.

4. The tube of claim 1, wherein a bottom face of the first portion of the cap includes a plurality of protrusions of predetermined size and location, and the cap fixture portion includes a corresponding plurality of non-perforated holes which correspond in size and location to the protrusions, the protrusions upon alignment with the corresponding holes being forcibly mated within the holes to securely retain the first portion of the cap on the cap fixture portion of the body.

5. The tube of claim 1, wherein the spout comprises a cavity communicating with the lower part of the body at one end of the spout and a sealing section at an opposite end of the spout, the sealing section being removable from the spout to expose the cavity.

6. The tube of claim 1, wherein the body is fabricated from plastic.

7. The tube of claim wherein the first portion and the second portion of the cap are hingedly connected by two hinges between which a spring articulation is positioned to snap the second portion of the cap between an open position and a closed position.

8. The tube of claim 1, wherein a notch extends between a perimeter surface of the upper part of the body and an edge of the recessed portion opposite the cap fixture portion to expose a tip of the second portion of the cap to facilitate opening of the cap by exerting an upward force on the exposed tip.

9. The tube of claim wherein the T-shaped recessed portion includes a low relief area in which the spout is located and a stepped high relief area at a level higher than the low relief area, the cap fixture portion being located in the stepped high relief area.

10. The tube of claim 9, wherein the first and second portions of the cap are hingedly connected by two hinges between which is positioned a spring articulation extending between the bottom faces of the first and second portions, the spring articulation being received in the low relief area adjacent to the stepped high relief area.

11. A monoblock tube comprising:

a monoblock body of substantially cylindrical configuration having an upper part and a lower part, the upper part of the body including a circular area of smaller diameter than the lower part and concentric therewith, the circular area including a substantially T-shaped recessed portion defining a low relief area and a high relief area at a level stepped from the low relief area, the high relief area including a cap fixture portion located toward a base of the T-shaped recessed portion, the low relief area including a spout non-centrally located within the circular area opposite the cap fixture portion for providing communication between the upper and lower parts of the body;

a removable cap having a first portion and a second portion connected together by a hinge mechanism for pivotal movement of the second portion relative to the first portion, the first and second portions of the cap defining a corresponding T-shape for reception within the T-shaped recessed portion of the circular area with the first portion being releasably attached to the cap fixture portion in the high relief area and the second portion covering the low relief area; and a resilient spring means between the first and second portions of the cap for urging the second portion of the cap with a snap action into one of two positions, the second portion in a first position being urged toward the low relief area and in a second position being urged to overlie the first portion, the resilient spring means extending between undersurfaces of the first and second portions and being received in the low relief area adjacent the high relief area.

12. The tube of claim 1 further comprising a stepped portion between the low and high relief areas, the stepped portion including a notch for receiving the spring means in the first position.

13. The tube of claim 11, wherein the spout and high relief area project from the low relief area to the same height above the low relief area.

14. A monoblock tube comprising:

a monoblock body having an upper part and a lower part, the upper part of the body including a recessed portion defining a low relief area and a high relief area at a level stepped from the low relief area, the high relief area including a cap fixture portion located in the recessed portion, the low relief area including a spout non-centrally located within the recessed portion opposite the cap fixture portion for providing communication between the upper and lower parts of the body;

a removable cap having a first portion and a second portion connected together by a hinge mechanism for pivotal movement of the second portion relative to the first portion, the first and second portions of the cap defining a shape corresponding to the recessed portion for reception within the recessed portion with the first portion being releasably attached to the cap fixture portion in the high relief area and the second portion covering the low relief area; and a resilient spring means between the first and second portions of the cap for urging the second portion of the cap with a snap action into one of two positions, the second portion in a first position being urged toward the low relief area and in a second position being urged to overlie the first portion, the resilient spring means extending between undersurfaces of the first and second portions and being received in the low relief area adjacent the high relief area.

15. The tube of claim 14, wherein the recessed portion is a T-shaped recessed portion.

16. The tube of claim 14, wherein the first portion of the cap has a thickness substantially equal to a depth of the high relief area and the second portion of the cap has a thickness substantially equal to a depth of the low relief area so that a top surface of the cap is level with an upper surface of the upper part of the body when the second portion of the cap is in the first position and the first portion is secured to the cap fixture portion.

* * * * *

UNITED STATES PATENT AND TRADEMARK OFFICE

CERTIFICATE OF CORRECTION

PATENT NO. : 5,213,235

DATED : May 25, 1993

INVENTOR(S) : Renato MIRANDA

It is certified that error appears in the above-identified patent and that said Letters Patent is hereby corrected as shown below:

Column 2, line 52, change "FIG." to --FIG. 1--;

line 60, change "FIG. 4" to --FIG. 4A--;

line 67, change "C,D,E" to --A,B,C--; and line 68, change "F" to --D--.

Signed and Sealed this

First Day of February, 1994

Bruce Lehman

*Attest:*

BRUCE LEHMAN

*Attesting Officer*

*Commissioner of Patents and Trademarks*